United States Patent [19]

Knight

[11] Patent Number: 4,854,572

[45] Date of Patent: Aug. 8, 1989

[54] PHYSICAL TRAINING ACCESSORY

[76] Inventor: Eric A. Knight, 17 Lakeshore Dr., Apt. B-1, Farmington, Conn. 06032

[21] Appl. No.: 133,525

[22] Filed: Dec. 16, 1987

Related U.S. Application Data

[63] Continuation-in-part of Ser. No. 923,388, Oct. 27, 1986, abandoned.

[51] Int. Cl.[4] ..... A63B 23/04

[52] U.S. Cl. ..... 272/70; 272/116; 272/119

[58] Field of Search ..... 272/70, 71, 93, 116, 272/119, 130, DIG. 9, 143; 280/213, 810; 244/143; 2/102, 11.5

[56] References Cited

U.S. PATENT DOCUMENTS

| | | | |
|---|---|---|---|
| 1,178,165 | 4/1916 | Lupton, Jr. | 280/810 |
| 1,757,854 | 5/1930 | Castagne | 244/143 |
| 2,018,062 | 10/1935 | Hardt | 280/810 |
| 4,220,299 | 9/1980 | Motter | 280/810 X |
| 4,344,620 | 8/1982 | Debski | 272/119 |
| 4,527,794 | 7/1985 | Dunn | 272/70 |
| 4,531,763 | 7/1985 | Toland | 280/810 |
| 4,658,442 | 4/1987 | Tomlinson et al. | 272/119 X |

FOREIGN PATENT DOCUMENTS

| | | | |
|---|---|---|---|
| 492784 | 9/1937 | United Kingdom | 280/810 |

*Primary Examiner*—Richard J. Apley
*Assistant Examiner*—Robert W. Bahr

[57] ABSTRACT

A physical training accessory comprises a garment or harness for securing the accessory to the body of a wearer, and a gatherable sail which is either permanently or detachably attached to the garment or harness. The sail, which may be comprised of any suitable gatherable material, is so fashioned that ground locomotion of the wearer, e.g., walking, running, skiing or skating, deploys the sail from a slack condition to a billowed condition, which increases air resistance which must be overcome by the wearer to continue the ground locomotion and so provides a valuable, extremely lightweight and compact training device. Fasteners may be provided to hold the sail in the slack condition for those times when the wearer does not wish to sustain the added air-resistance provided by the billowed sail.

15 Claims, 3 Drawing Sheets

PHYSICAL TRAINING ACCESSORY

CROSS-REFERENCE TO RELATED APPLICATION

This application is a continuation-in-part of U.S. patent application Ser. No. 923,388, filed Oct. 27, 1986, now abandoned, in the name of Eric A. Knight and entitled "Physical Training Accessory".

BACKGROUND OF THE INVENTION

1. Field Of The Invention

The present invention is concerned with a physical training accessory, and more specifically is concerned with an accessory comprising an air-resistance member, i.e., a sail, which is deployable upon ground locomotion of the wearer in order to increase the air-resistance to such locomotion.

2. Description of Related Art

It is a known expedient when conducting physical training to carry weights, in order to increase the effort required to carry out a particular physical movement or ground locomotion (e.g., running) and thereby enhance increases in the strength and endurance of the user. For example, it is known to wear wrist and/or ankle weights or to carry weights in the hands or in special vest pockets during running or jogging in order to increase the effort required. The use of such weights has certain disadvantages in that, particularly in the case of long distance runners, the weights tend to stress the joints of the user. The weights are localized at a particular part of the body, usually the ankles or the wrists or both, and tend to tire and stress particular muscles and joints of the user. Further, if they are not to be abandoned, the weights must be carried by the user (or someone else) even when a point is reached, for example, on the return leg of a run, in which the weights may no longer be desired. U.S. Pat. No. 4,344,620 (A. J. Debski, 1982) seeks to overcome this problem by use of a weight vest having compartments designed to hold water or other fluids to provide added weight, the patent stating that the water may be expelled from the compartment to facilitate easy and lightweight transportation of the vest. U.S. Pat. No. 4,658,442 (D. Tomlinson et al, 1987) discloses a sleeveless vest designed for use as a physical training device having pockets sized to receive conventional weights which may be bent to conform to the wearer's body.

It is also a known expedient in the art to provide wind-sail appliances which will increase the air resistance acting upon the wearer either during ground locomotion such as skiing or ice-skating, or upon falling or jumping so that the device acts in the manner of a parachute. Each of these known prior art expedients requires that the wearer extend his or her arms in order to deploy the parachute or sail-like member. For example, reference is made to the following U.S. patents, each of which provides a parachute or sail-like device which requires the wearer to extend and maintain his or her arms in an extended position in order to deploy the device. These patents are U.S. Pat. Nos. 1,178,165 (B. M. Lupton, Jr., 1916), 1,757,854 (C. H. Castagne, 1930), 4,220,299 (W. G. Motter, 1980) and 4,531,763 (D. A. Toland, 1985). A skiing accessory which is also characterized by requiring the wearer to maintain his or her arms in an extended position in order to utilize the device is disclosed by British Patent Specification No. 492,784 (Hans Thirring, 1937).

There aforesaid wind-sail devices have the disadvantage that the wearer is constrained to maintain his or her arms in an extended position which not only prevents the adoption of a natural arm movement and positioning for exercises such as running, skating or skiing, but further requires the arms to remain extended and support the wind resistance offered by the sail, thereby limiting the duration of use of the device as the arms will undoubtedly become tired long before the useful or desired duration of the training period is reached.

U.S. Pat. No. 4,527,794 (J. P. Dunn, 1985) discloses a training device comprising a rigid frame adapted to be fitted over the shoulders of the wearer, the frame carrying an air foil which may comprise a fabric covering, and being further secured to the wearer by a belt about the wearer's waist. In one embodiment, the airfoil or sail is optional (col. 3, lines 39–40) and the rigid frame, which has handles mounted on it, is sufficiently flexible so that the wearer, by maintaining his or her arms extended, may use the frame as an arm exerciser while running. The Dunn device is not collapsible, i.e., the airfoil is frame-mounted and therefore is not gatherable, and suffers a disadvantage similar to that of the use of weights; the device must be transported even when it is no longer desired to have to overcome the added wind resistance provided by the device, the weight of the frame must be borne at all times and, even during training, the weight is concentrated on the shoulders and at the waist.

The present invention provides a physical training accessory which provides significant advantages and uses, has the capability of increasing air resistance to ground locomotion by the wearer, thereby enhancing training, is lightweight and gatherable, and overcomes the stated disadvantages of prior devices such as the use of weights, the need to maintain the user's arms in an extended position, and bulkiness and weight.

SUMMARY OF THE INVENTION

The present invention provides a physical training accessory which is worn to gain the effect of wind or air-resistance serving to increase the effort required by the wearer to effectuate ground locomotion, e.g., to effectuate running. The device of the invention includes a gatherable sail which is freely deployable between a billowed condition, in which it serves as an air brake to provide increased air-resistance to ground locomotion by the wearer, and a slack condition in which the air-resistance it offers is minimized or substantially eliminated. The device of the invention may be provided in an extremely lightweight form so that when borne by the wearer in a slack condition it provides a negligible, practically non-existent burden to the wearer. The air resistance provided by the device generally increases with increased velocity of locomotion of the wearer.

Generally, in accordance with the present invention, there is provided a physical training accessory comprising a gatherable sail mounted on a securement means, the accessory being dimensioned and configured for attachment to the torso of a wearer while leaving the wearer free to move and position his or her limbs substantially independently of deployment of the sail. The gatherable sail has a wind-catching surface and is dimensioned and configured to be freely deployable between a slack condition and a billowed condition and, further, to be deployable to the billowed condition by ground level air velocity acting on the wearer. The billowed condition of the sail serves to increase air resistance to ground locomotion, e.g., walking, running, skiing, skating or cycling, by the wearer.

In one aspect of the invention, the securement means comprises a garment having a shoulder area and a rear waistband area, and the gatherable sail is fastened to the garment at the shoulder and waistband areas thereof. The sail includes a pair of air-scoop edges, respective ones of which extend between the shoulder and waistband areas of the garment adjacent laterally opposite sides of the back of the wearer. In another aspect of the invention, the sail has a top air-scoop edge extending along at least a portion of the top edge of the sail.

In another aspect of the invention, the sail has a top edge and a bottom edge, each of which is affixed to the securement means at the back of the wearer's torso. The top edge of the sail is disposed above its bottom edge, and respective left and right air-scoop edges extend between the top and bottom edges at the laterally opposite ends thereof.

Still another aspect of the invention provides a physical training accessory comprising a garment comprising at least a shirt-like portion having a shoulder area and a rear waistband area, and a gatherable sail having a wind-catching surface defined between a top edge and a bottom edge of the sail. The top edge of the sail is secured to the shoulder area of the garment and the bottom edge of the sail is secured to the rear waistband area of the garment, the sail further having a pair of lateral air-scoop edges and, optionally, a top air-scoop edge, respective ones of the lateral air-scoop edges extending at least part way between the shoulder and waistband areas of the garment at laterally opposite sides of the sail. The gatherable sail is dimensioned and configured to be freely deployable substantially independently of positioning or movement of the wearer's limbs both (i) between a slack condition and a billowed condition, and (ii) to the billowed condition by ground level air velocity relative to the wearer.

Yet another aspect of the invention provides a physical training accessory comprising a garment having a torso back portion and a gatherable sail affixed to the garment and facing the torso back portion. The gatherable sail is comprised of a gatherable material and is dimensioned and configured to be freely deployable and to be deployable to the billowed condition as described above in the immediately preceding paragraph.

Other aspects of the invention include features such as the gatherable sail being reinforced, e.g., by darts formed in the fabric of the sail, at one or more locations, e.g., intersecting the air-scoop edges of the sail, so that air resistance offered by the sail tends to billow the sail into a concave configuration of the wind-catching surface.

Still other aspects include the provision of retaining means mounted on the accessory, which means are selectively moveable between a retaining position in which they engage the sail to hold, respectively, all or part of it in its slack position against ground level air velocity acting on the sail, and a release position in which the retaining means frees the sail to deploy to its billowed condition.

Still another aspect of the invention provides for one or more pressure-relief means to be formed in the sail, e.g., one or more vents may be formed in the sail and the vents may have positionable closure means, e.g., flaps, associated therewith.

As used herein and in claims, the following terms have the indicated meanings.

The term "gatherable" as applied to the sail, i.e., the term "gatherable sail", means a sail which can be gathered into folds so as to place the sail in a slack condition from which it may be deployed into a billowed condition, thence back to its slack condition. A piece of soft cloth or fabric is inherently gatherable.

The term "ground level air velocity" means the air velocity relative to the wind-catching surface of the gatherable sail of the accessory of the present invention. With the wind-catching surface facing the back of the wearer of the accessory, in still air the ground level air velocity is equal to the wearer's velocity of forward ground locomotion, e.g., the wearer's running speed. The ground level air velocity in wind conditions is a combination of the wearer's velocity in the direction away from the wind-catching surface of the sail plus the effective wind vector acting on the wind-catching surface of the sail.

The term "shirt-like garment" is intended to broadly include any garment worn about the upper torso of a wearer such as, for example, T-shirts or pull-over type sweaters or sweatshirts, front opening shirts, jackets, vests, or the like.

The term "ground locomotion" embraces any means by which one such as the wearer of the training accessory of the invention, moves along the ground or other surface propelled by his or her own muscle power, optionally aided from time to time by gravity. Thus, the term includes walking, running, skating, skiing, skateboarding, cycling, etc.

DETAILED DESCRIPTION OF THE PREFERRED EMBODIMENTS

Figure 1:
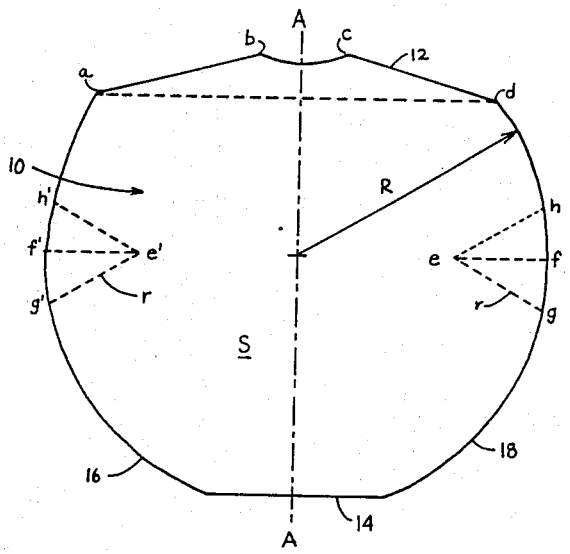
FIG. 1 is a plan view of a flat piece of gatherable material cut to a pattern suitable for making from it a sail in accordance with an aspect of the present invention.

Referring now to FIG. 1, there is shown a gatherable, lightweight fabric 10, for example, a lightweight nylon fabric, cut to a pattern which is symmetrical about the central axis A—A. Features of gatherable sail 20 (FIGS. 2 and 3) to be made from material 10 are illustrated in FIG. 1 and include a top edge 12 comprised of a shoulder segment a–b, a neck segment b–c, another shoulder segment c–d, a bottom edge 14, and arcuate lateral side edges 16 and 18 which are mirror images of each other. Gatherable sail 20 may be prepared by cutting a suitable fabric to provide a circular piece of fabric of radius R, side edges 16 and 18 each comprising equal arcs of a circle of radius R, and bottom edge 14 comprising a chord of the circle. Top edge 12 is cut above the imaginary chord connecting points a and d (chord a–d is shown in dash line in FIG. 1) in a pattern which will generally lie along both shoulder portions and the rear collar or neck portion of a garment such as a T-shirt.

Figure 1A:
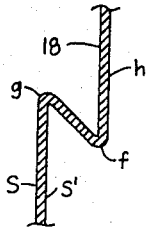
FIG. 1A is a partial edge view of the material of FIG. 1 showing a partially completed fold for forming a dart therein.
Figure 1B:
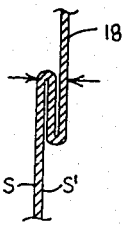
FIG. 1B is a view corresponding to FIG. 1A showing the completed dart.
Figure 1C:
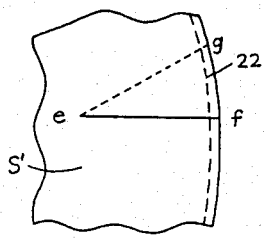
FIG. 1C is a view of the dart area of FIG. 1 on a slightly enlarged scale showing the formation of a completed dart therein.

A pair of fold lines e–f and e–g are shown in dash lines and a placement line e–h is shown in a dotted line in FIG. 1, all of these lines intersecting arcuate lateral side edge 18. In a corresponding mirror image, a pair of fold lines e′–f′ and e′–g′ and a placement line e′–h′ are shown intersecting arcuate lateral side edge 16. The side S of gatherable material 10 visible in FIG. 1 will eventually become the wind-catching surface WS (FIG. 3) of the gatherable sail 20 to be made from material 10, and the opposite side S′ (FIGS. 1A and 1B) will eventually provide the outside surface of the finished gatherable sail 20. The thickness of the gatherable material 10 is exaggerated in FIGS. 1A and 1B, for purposes of illustration. The fabric or material 10 is folded as indicated in FIG. 1A along fold lines e–f and e–g and fold line e–g is placed along placement line e–h as illustrated in FIG. 1A. The material 10 may then be sewn along the fold line e–g to sew together the three plies of fabric in the area indicated by the two facing unnumbered arrows in FIG. 1B. The result is a folded dart as shown in FIG. 1C having a stitched line running along line e–g (which is co-incident with placement line e–h) and a fold line e–f. Fold line e–f need not be sewn, although it may, so that the dart e–g–h in effect comprises an upside down (as viewed in FIG. 1C) "pocket". The procedure is repeated along fold lines e′–f′ and e′–g′ with the result that the sail 20 has darts formed therein intersecting its respective opposite lateral sides 16 and 18.

Figure 2:
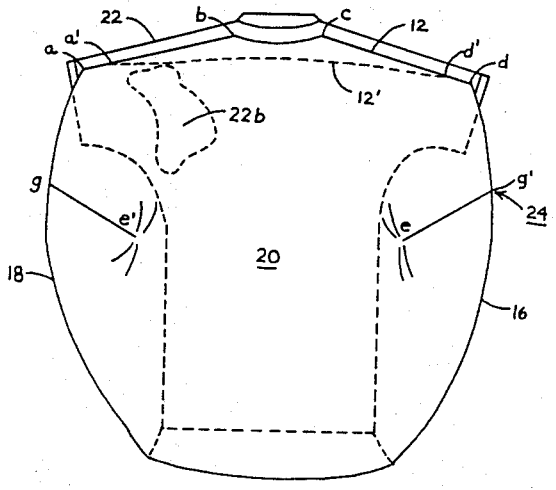
FIG. 2 is a back view of one embodiment of a physical training accessory in accordance with the present invention utilizing a sail formed from the material of FIG. 1.
Figure 3:
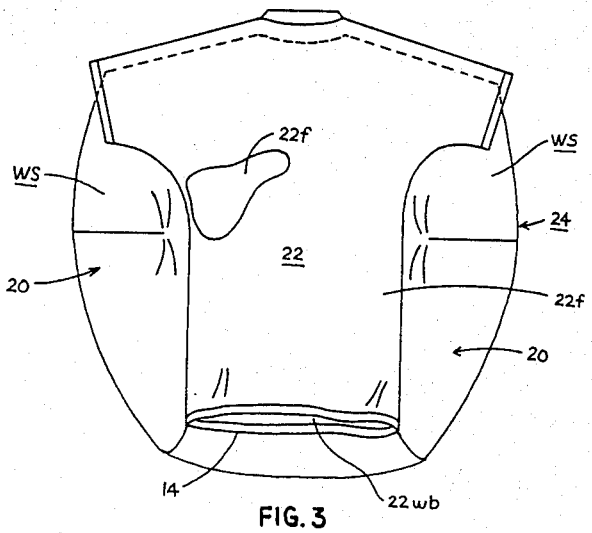
FIG. 3 is a front view of the physical training accessory of FIG. 2.

The darts stiffen or reinforce the material 10 of sail 20 adjacent its opposite lateral sides 16, 18 which, in the finished accessory, serve as respective air-scoop edges. That is, with the sail 20 attached to a securement means as illustrated in FIG. 2, and a ground level air velocity acting on it (in the direction shown by the arrow V in FIG. 7), air will flow over the lateral, air-scoop edges 16, 18 into the sail 20 (FIGS. 2 and 3). Upon a ground level air velocity impinging upon wind-catching surface WS, the sail 20 (FIGS. 2 and 3) has a scoop-like configuration which will billow into the deployed position illustrated in FIG. 7, upon ground locomotion of the wearer providing a sufficiently high ground level air velocity to act on the sail 20. For enhanced strength and appearance of the finished article, a hem 22 (FIG. 1C) may be sewn along the entire periphery of gatherable material 10, i.e., along the entirety of top edge 12, bottom edge 14 and lateral side edges 16 and 18.

Typical pattern sizes for the gatherable material 10 of FIG. 1 to provide sails 20 which are suitable for small, medium, large and extra-large men's size T-shirts respectively, are as shown in the following Table:

| | FIG. 1 | | | |
|---|---|---|---|---|
| | INCHES | | | |
| DIMENSION | Small | Medium | Large | Extra-Large |
| R | 18.5 | 19.0 | 19.5 | 20.0 |
| r(1) | 8.0 | 8.5 | 9.0 | 9.5 |
| x | 7.5 | 8.0 | 8.5 | 9.0 |

(1)Each of the following lines in FIG. 1 is equal to "r": e-g, e-h, e′-g′, and e′-h′.

In the embodiment illustrated in FIGS. 2 and 3, the securement means is a shirt-like garment comprising an ordinary T-shirt 22 having a front portion 22*f* and a back portion 22*b*. The physical training accessory comprising T-shirt 22 having sail 20 affixed thereto is generally indicated at 24 in FIGS. 2 and 3. In FIG. 3, the lower or waistband area of front portion 22*f* is shown slightly raised to reveal the rear or back waistband portion 22*wb* of T-shirt 22. Sail 20 is seen to have its top edge 12 affixed to the shoulder or yoke portion of T-shirt 22, the "shoulder portion" of a shirt-like garment such as T-shirt 22 being generally that portion extending along both shoulders of the wearer. As so used, the "shoulder portion" may optionally extend, in the case of a garment which has sleeves, to the upper or shoulder portions only of the sleeves of the garment and may optionally include the rear collar portion. For example, as best appreciated from FIGS. 2 and 3, the top edge 12 of gatherable sail 20 is affixed to the T-shirt 22 along a shoulder area which includes the shoulder portion of T-shirt 22, including the upper or shoulder portion only of the sleeves of the T-shirt. In accordance with the teachings of the present invention, if the securement means comprises a garment having sleeves, the sail is not affixed to the sleeves substantially beyond the shoulder portions thereof because to do so would prohibit movement and placement of the wearer's arms independently of deployment of the sail. In fact, when a garment is employed as the securement means, the garment may be a sleeveless garment. In the illustrated embodiment, top edge 12 is affixed, as by sewing, continuously along top edge 12 from point a to point d so that the entire top edge 12 is affixed to the shoulder area of T-shirt 22. With a portion of the sail 20 thus connected to the shoulder portions of the sleeves, movement or placement of the wearer's arms may slightly affect the initiation of deployment of the sail 20 to the billowed condition, but the sail 20 is deployable between the billowed and slack condition substantially independently of movement or placement of the wearer's arms. The wearer may thus position and/or move his or her arms without interfering with deployment of the gatherable sail 20 and without interfering with action of the wind (blowing wind and/or relative air movement generated by ground locomotion of the wearer) in deploying the gatherable sail 20 to its billowed condition. Similarly, the bottom edge 14 of sail 20 (FIG. 3) is affixed, as by sewing, to the entire rear waistband portion 22*wb* of T-shirt 22.

Figure 6:
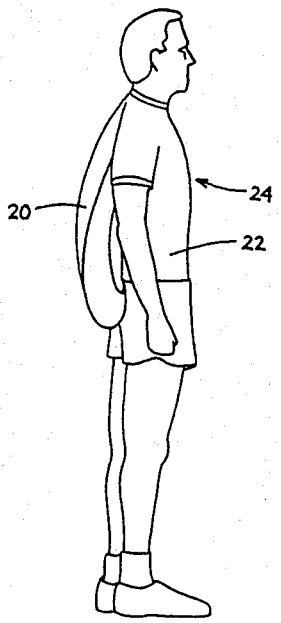
FIG. 6 is a side view of a person standing still and wearing the embodiment of the invention illustrated in FIGS. 2 and 3.
Figure 7:
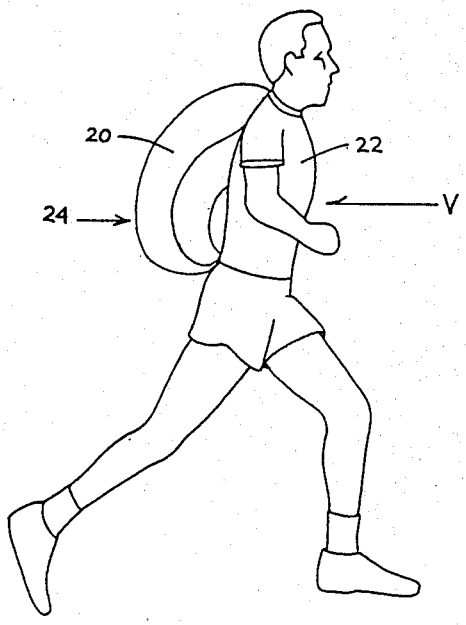
FIG. 7 is a side view of the person of FIG. 6 in midstride with the sail of the device shown in a billowed condition.

FIGS. 6 and 7 show the physical training accessory 24 being worn by a wearer who is standing still in FIG. 6 so that gatherable sail 20 is hanging in a slack position. The "slack" position of the gatherable sail of the invention is the folded configuration of the sail in which the wind-catching surface WS is folded and collapsed so that the sail offers little or no wind resistance as compared to its billowed condition in which it acts in the manner of a parachute-type drag. In FIG. 7, the wearer is shown as running, FIG. 7 illustrating the wearer in mid-stride, and the relative ground level air velocity (illustrated as arrow V) generated by the ground locomotion (in this case, running) of the wearer has deployed sail 20 to its billowed condition, thereby requiring the runner to overcome the resultant increased air resistance. The faster the wearer runs, the greater is the air resistance which must be overcome and this enhances the training effect of the running, resulting in greater stress on the runner and the development of greater endurance. When the runner is through running, the weight of the sail 20 is negligible and the wearer does not have to contend with the necessity of carrying about weights when, for example, heading to or returning from the training site. The direction of running (or other ground locomotion) may be selected to maximize or minimize the effect of blowing winds, if any, on the wind resistance offered by sail 20.

FIGS. 6 and 7 well illustrate advantages and utility of the present invention in that in FIG. 6 the wearer, being at rest, is negligibly, if at all, burdened by the physical training accessory of the invention because, in addition to an ordinary T-shirt, it consists of merely a lightweight piece of fabric or material, such as a light gauge nylon, sewn to the T-shirt. There is no rigid frame nor any weights or the like to impose a dead weight burden on the wearer. Nonetheless, the wearer, while running, must overcome considerable wind resistance, which increases in proportion to the wearer's ground level relative air velocity, e.g., to the running velocity, of the wearer plus or minus the blowing wind vector acting on the sail 20. Thus, as the runner illustrated in FIG. 7 increases his speed of running the air-resistance engendered by the sail member 20 increases. The runner's joints are not stressed as would be the case by weights affixed to ankles or wrists. Instead, the enhanced air-resistance acts over a relatively large area of the runner's body, substantially the entire portion of his front torso covered by the T-shirt.

In an alternate embodiment of the invention, the gatherable sail may be secured to the securement means with only spaced-apart portions of the top edge of the sail fastened to the securement means so as to provide an additional air-scoop edge along the shoulder area. For example, with reference to FIG. 2, the top edge 12 of sail 20 may be secured to T-shirt 22 only between points a and a' and points d and d'. In this embodiment, edge 12 may be configured as shown by dash line 12' in FIG. 2 and the top edge 12' between points a' and d' is left free to define a top air-scoop edge. (Similarly, in the FIG. 8 embodiment, the portion of top edge 12' between straps 28*a* and 28*b* defines a top air-scoop edge.) With this construction, the accessory of the invention is particularly well suited for use by cyclists as well as runners because the normal cycling position of the wearer bent forward over the handle bars, serves to present the top air-scoop edge 12' (FIGS. 2 and 8) to the air stream flowing over the cyclist's body. The provision of a top air-scoop edge at the top edge of the gatherable sail as well as air-scoop lateral edges along each of the lateral side edges of the sail, enhances the effectiveness of the accessory for ground locomotion by a wearer both in an upright position and a forward bent-over position of the torso.

Figure 4:
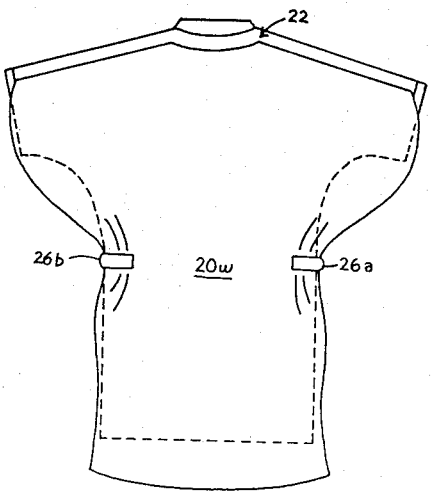
FIG. 4 is a back view of another embodiment of the invention generally identical to that of FIG. 2 except for the addition of retaining means thereon to hold the sail in a slack condition.
Figure 5:
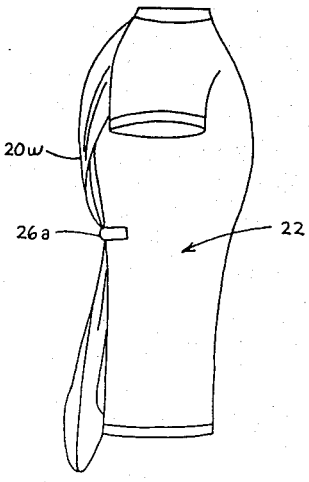
FIG. 5 is a side view of the physical training accessory of FIG. 4 showing the garment portion thereof as it would appear when being worn by a wearer and the sail portion thereof retained in the slack condition by the fastening means.

FIGS. 4 and 5 illustrate a modified form of the invention in which a T-shirt 22 has a sail 20*w* affixed thereto, and further includes a pair of retaining means 26*a*, 26*b* which, in the illustrated embodiment, comprise short straps having one end of each strap affixed to a lateral side portion of the T-shirts 22. The free end of the straps 26*a* and 26*b* may be provided (on the side thereof facing the T-shirt 22) with one component of a hook and loop type fabric fastener means, such as the fastener tapes sold under the trademark VELCRO. Small patches of the other component of the hook-and-loop type fabric fastener means are affixed at appropriate locations on the outer surface of sail 20*w* so that, with the sail 20*w* in its slack position, retaining means 26*a* and 26*b* may be secured to the sail 20*w* to retain it in a slack, folded position. With sail 20*w* being thus retained by retaining means 26*a* and 26*b*, even upon the wearer facing the wind, or engaging in ground locomotion by running or walking, the sail 20*w* is maintained in the slack position and significant wind resistance provided by the sail is avoided. Thus, the wearer may readily disable the sail in situations where the wearer does not desire to have to overcome the increased air-resistance. Obviously, any suitable retaining means other than the one illustrated may be utilized, for example, a belt-like cinch may be worn about the torso of the wearer in the vicinity of the waist or slightly above. The sail 20*w* may also be held in the slack condition when desired by being folded and tucked into a suitable pocket-like retaining means (not shown) provided on the rear of the T-shirt.

Instead of, or in addition to, the use of retaining means to enable selective disablement of the sail by holding it in its slack condition, the sail may be made selectively detachable from the securement means. For example, the sail may be made readily attachable and detachable from the garment or securement means by the use of mechanical fasteners such as snaps, hooks and eyes, or the like, or by hook and loop fabric fasteners, such as the fasteners of the type sold under the trademark VELCRO. With such detachable mounting of the sail on the garment, the garment may be worn independently of the sail, which may be folded and easily carried or stowed. The sail may be constructed of any suitable gatherable material, such as a lightweight nylon material. For example, a suitable and preferred material is a lightweight nylon woven fabric weighing about one and one-quarter to two ounces per square yard. One suitable nylon material for the sail weighs about 1.61 ounces (45.68 grams) per square yard. Obviously, any suitable material may be utilized including plastic (synthetic organic polymer) sheets, light cotton fabrics, silk, rayon, materials comprising blends of synthetic and natural fibers, etc.

Figure 8:
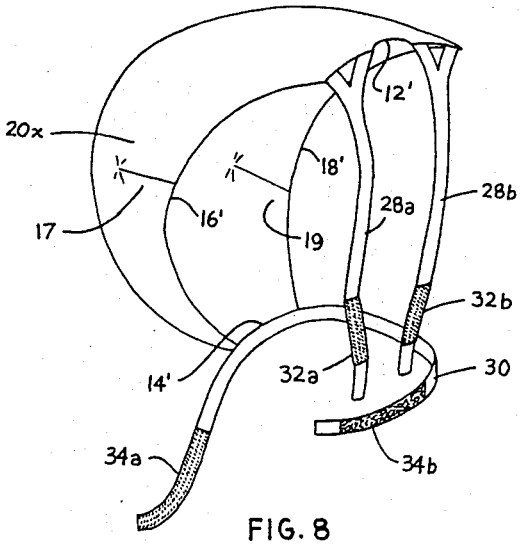
FIG. 8 is a perspective view of another embodiment of the invention shown in billowed condition.

FIG. 8 illustrates another embodiment of the invention in which the securement means comprises a pair of shoulder harness straps 28a and 28b and a waist cinch or belt 30. This is in contrast to the embodiments illustrated in FIGS. 2–3, 4–5 and 6–7, in which the T-shirt comprises the securement means. In the embodiment illustrated in FIG. 8, a sail 20x is illustrated in its billowed condition and has a top edge 12', a bottom edge 14' and opposite lateral side, air-scoop edges 16' and 18'. Darts 17 and 19 are formed in sail 20x in the vicinity of, respectively, lateral side edges 16' and 18' to facilitate deployment of sail 20x into a scoop-like, billowed condition. Shoulder harness strap 28a has a Y-shaped end suitably affixed to one shoulder segment of top edge 12', and shoulder harness strap 28b has an identical Y-shaped end suitably affixed to the opposite shoulder end of top edge 12'. Shoulder straps 28a and 28b have fastener means 32a and 32b comprising, in the illustrated embodiment, one component of a hook and loop type fabric fastener such as those sold under the trademark VELCRO. Fasteners 38a and 38b are adapted to lockingly engage the other component (not visible in FIG. 8) of the hook and loop type fabric fastener which is disposed on the interior of belt 30.

Belt 30 has an intermediate portion which is sewn or otherwise suitably affixed to the bottom edge 14' of sail 20x and also has components of hook and loop type fabric fastener 34a and 34b, similar in construction to 32a and 32b, located on, respectively, an inside and outside surface of belt 30. Fasteners 34a and 34b thus cooperate to enable belt 30 to be cinched about the waist of the wearer to accommodate a wide range of waist sizes. Fasteners 32a and 32b and their complementary portions (not visible in FIG. 8 but located generally on the opposite side of belt 30 from fastener 34b) serve to fasten shoulder harness straps 28a and 28b to belt 30. In this manner, the securement means comprised of straps 28a, 28b and belt 30 and their associated fabric fasteners, serves to secure sail 20x to the body of the wearer.

Retaining means corresponding to retaining means 26a and 26b of the embodiment of FIGS. 4 and 5 may also be provided in the embodiment of FIG. 8. For example, retaining means could be affixed to approximately the mid-point of shoulder straps 28a and 28b and corresponding means may be provided at an appropriate location, approximately at the mid-point of sail 20x, in order to secure sail 20x in a slack condition to shoulder straps 28a and 28b. In this manner, sail 20x can be maintained in a slack condition even upon ground locomotion by the wearer or with the wearer facing into the wind.

Figure 9:
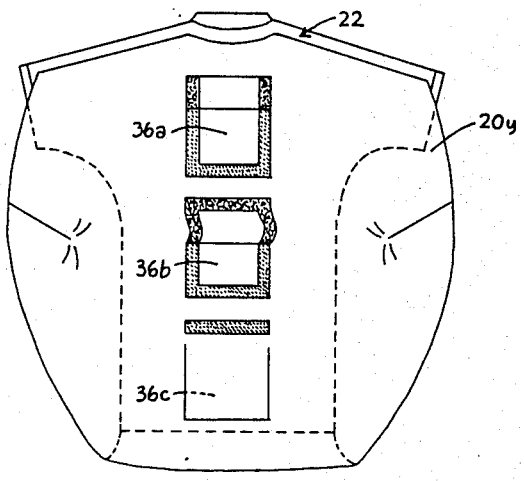
FIG. 9 is a back view of another embodiment of a physical training accessory in accordance with the present invention, comprising a garment portion and a sail portion, the latter having pressure-relief means.
Figure 10:
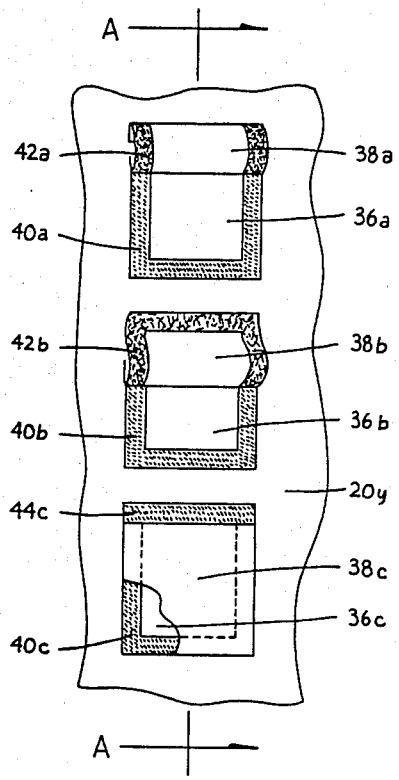
FIG. 10 is a view on an enlarged scale of a segment of the sail of the accessory of FIG. 9 showing one of the three respective pressure-relief means in open, intermediate and closed positions.
Figure 10A:
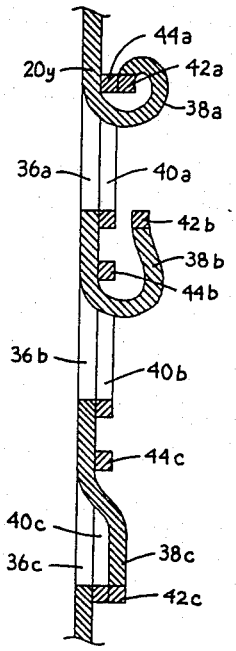
FIG. 10A is a section view taken along line A—A of FIG. 10.

In the embodiment illustrated in FIGS. 9, 10 and 10A, the securement means comprises a T-shirt 22 identical or similar to those illustrated in the embodiments of FIGS. 2–3, 4–5 and 6–7, and has affixed thereto a sail 20y which has formed along the longitudinal center line thereof three pressure relief means comprising, in the illustrated embodiment, vents 36a, 36b, and 36c. (For improved clarity of illustration, in FIG. 10A the thickness of the gatherable of sail 20y is greatly exaggerated.) Vents 36a–36c each comprises a square or rectangular opening having associated therewith positionable closure means comprising, in the illustrated embodiment, flaps 38a, 38b, and 38c. Flap 38a is shown in its secure open position, flap 38b is shown open but not secured, and flap 38c, a corner of which is broken away for purposes of illustration, is shown in its secured-closed position. Each of the vents comprises a square or rectangular opening formed by a U-shaped cut in the material of sail 20y, the resulting flaps of material being utilized as the respective flap 38a, 38b and 38c. The periphery of each U-shaped cut has fastened to it a U-shaped segment of first holding means 40a, 40b and 40c, each comprising a piece of a hook and loop fabric fastener such as those sold under the trademark VELCRO. A series of U-shaped second holding means 42a, 42b, and 42c, each comprising a component of such fabric fastener is attached to the periphery of its associated flap 38a, 38b and 38c to extend the size of the flap and align each second holding means with its corresponding first holding means. Third holding means 44a, 44b and 44c, each comprising a component of such fabric fastener component, are positioned adjacent the hinge side of their associated flaps 36a, 36b and 36c.

In order to secure any one of the flaps in the fully closed position illustrated with respect to flap 38c, the associated first and second holding means 40c and 42c are pressed into contact with each other, thereby completely covering vent 36c with flap 38c. In order to open one or more of the vents to thereby relieve the air pressure and reduce the amount of drag provided by the gatherable sail 20y, as illustrated with respect to flap 38a, this flap is opened and folded back so that the transverse segment of second holding means 42a is pressed into contact with the associated third holding means 44a. In this manner the flap is held securely in the open position. Maximum air resistance is provided by sail 20y when all flaps are secured in the closed position. One or more of the flaps may be opened to reduce the air resistance, with the minimum air resistance of course being provided when all flaps are in the fully open position. Flap 38b is shown as turned-back, but not yet secured to its associated second holding means 44b (FIG. 10A). With the illustrated construction, it will be appreciated that any given flap may, if desired, be secured to its associated second holding means so as to only partially close the vent so as to adjust the size of the vent opening.

Figure 11:
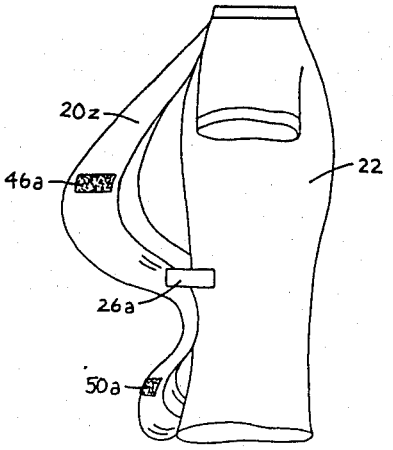
FIG. 11 is a side view of a physical training accessory similar to that of FIG. 5, showing the garment portion thereof as it would appear when being worn by a wearer and the sail portion thereof retained in a partially deployed condition.
Figure 12:
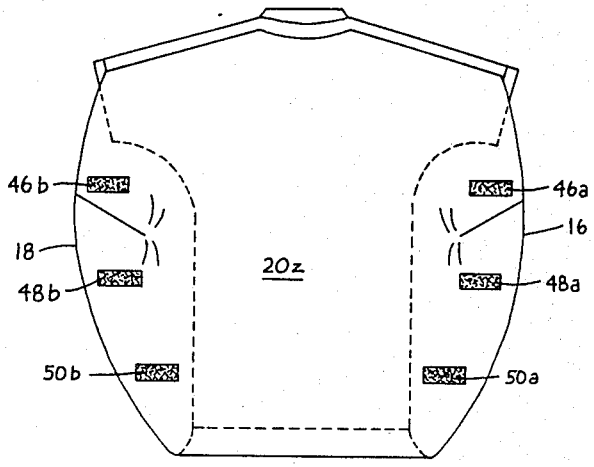
FIG. 12 is a back view of the garment of FIG. 11.

FIGS. 11 and 12 illustrate an embodiment of the invention similar or identical to that of FIG. 5 but in which the sail 20z has a plurality of paired sail holding means 46a/46b, 48a/48b and 50a/50b. The paired sail holding means are longitudinally spaced along sail 20z and respectively adjacent its air-scoop edges 16 and 18. With this arrangement, retaining means 26a and 26b may be respectively affixed to any one of the pairs 46a/46b, 48a/48b or 50a/50b. When fastened to sail holding means 48a/48b or 50a/50b, sail 20z is held in a partial release position in which part, but not all, of the gatherable sail 20z is freed to deploy to a billowed condition and part is retained in a slack condition. Thus, as illustrated in FIG. 11, the air resistance provided by ground locomotion of the wearer is able to billow sail 20z only to a partially billowed position, thereby reducing the amount of drag imposed by the partially billowed sail 20z to a value less than that attainable by freeing the entire sail to be deployed to a fully billowed condition.

In all of the embodiments of the invention illustrated, it will be seen that the gatherable sail (20, 20w or 20x) is freely deployable between the slack and the billowed conditions and is freely deployable to the billowed condition by action of the wind or air velocity acting on the sail, without need for manipulation by the wearer. Because the gatherable sail is not mounted on a frame or other rigid retaining means, nor is otherwise encumbered by structural or support members which would inhibit or restrain its movement, the gatherable sail can freely move between the deployed and billowed conditions, and can be deployed to the billowed condition solely in reaction to the ground level air velocity acting upon it.

Various modes of ground locomotion by the wearer include walking, especially speed walking, jogging, running, ice skating, roller skating, skiing, skateboarding, cycling, sledding and the like. Although primarily designed to provide a drag or air-resistance which must be overcome by the muscle power of the wearer during ground locomotion in order to increase the wearer's endurance and enhance the effectiveness of physical training, the training accessory of the invention may have other applications. For example, it may be utilized to slow the speed of a skier, a skater or a sledder, thereby facilitating training in maneuvers which are more difficult to accomplish at higher speeds. Thus, it is possible that a skier or skater may be able to train at slower speeds to provide a greater margin for error and to assist a coach or teacher in detecting errors and helping the trainee to overcome them.

While the invention has been described in detail with respect to specific preferred embodiments thereof, it will be appreciated that upon a reading and understanding of the foregoing, certain variations to the preferred embodiments will become apparent, which variations are nonetheless within the spirit and scope of the invention and the appended claims.

What is claimed is:

1. A physical training accessory comprising:

a gatherable sail having a wind-catching surface and being dimensioned and configured to be freely deployable between a slack condition and a billowed conditioned substantially independently of the movement and positioning of the wearer's arms, the sail being deployable to the billowed condition solely by ground level air velocity relative to the wearer such that the billowed condition of the sail serves to increase air resistance to ground locomotion of the wearer; and an entirely flexible securement means for securing the gatherable sail to the torso of the wearer.

2. The accessory of claim 1 wherein the securement means comprises a garment having a shoulder area and a rear waistband area, and the gatherable sail is fastened to the garment at the shoulder and waistband areas thereof and includes a pair of air-scoop edges, respective ones of which extend between the shoulder and waistband areas of the garment adjacent laterally opposite sides of the back of the wearer.

3. The accessory of claim 1 wherein the sail has (a) a top edge and a bottom edge, each affixed to the securement means at the back of the wearer's torso, the top edge being disposed above the bottom edge, and (b) respective left and right air-scoop edges extending between the top and bottom edges at the laterally opposite ends thereof.

4. The accessory of claim 3 wherein the sail has a top air-scoop edge extending along at least a portion of the top edge of the sail.

5. A physical training accessory comprising:

an entirely flexible garmet having a shoulder area and a rear waist area; and, a gatherable sail having a wind-catching surface defined between a top edge and a bottom edge of the sail, the sail being dimensioned and configured to be freely deployable between a slack condition and a billowed condition substantially independently of the movement and positioning of the wearer's arms, the top edge of the sail being affixed to the shoulder area of the garment and the bottom edge of the sail being affixed to the rear waist area of the garment, and the sail further having a pair of lateral air-scoop edges on laterally opposite sides of the sail extending at least part way between the shoulder and rear waist area of the garment, the sail being deployable to the billowed condition solely by ground level air velocity relative to the wearer such that the billowed condition of the sail serves to increase air resistance to ground locomotion of the wearer.

6. The accessory of claim 5 further including a top air-scoop edge extending along at least a portion of the top edge of the sail.

7. A physical training accessory comprising:

an entirely flexible garment having a torso back portion; and a gatherable sail affixed to the garment and having a wind-catching surface facing the torso back portion, the gatherable sail being dimensioned and configured to be freely deployable between a slack condition and a billowed condition substantially independently of the movement and positioning of the wearer's arms, the sail further being deployable to the billowed condition solely by ground level air velocity relative to the wearer such that the billowed condition of the said serves to increase air resistance to ground locomotion of the wearer.

8. The accessory of any one of claims 1, 2, 3, 4, 5, 6 or 7 wherein the gatherable sail is reinforced at one or more locations so that air resistance offered by the sail tends to billow the sail into a concave configuration of the windcatching surface.

9. The accessory of claim 8 wherein the gatherable sail is reinforced by one or more darts formed therein.

10. The accessory of any one of claims 3, 4, 5, 6 or 7 wherein the gatherable sail is reinforced by one or more darts formed therein with at least one dart intersecting each of the air-scoop edges.

11. The accessory of any one of claims 3, 4, 5, 6 or 7 wherein the garment has a pair of sleeves each comprised of at least a shoulder portion, and respective portions of the sail are affixed to the shoulder portion only of the sleeves.

12. The accessory of any one of claims 1, 2, 3, 4, 5, 6 or 7, further including retaining means mounted thereon which are selectively moveable between a retaining position in which they engage the sail to hold it in its slack position against ground level air velocity acting on the sail, and a release position in which the retaining means free the sail to deploy to its billowed condition.

13. The accessory of claim 12 wherein the retaining means are dimensioned and configured to also be moveable to a partial release position in which they serve to free part but not all of the sail to deploy its billowed condition, and retain part of the sail in its slack condition.

14. The accessory of any one of claims 1, 2, 3, 4, 5, 6 or 7 wherein the gatherable sail has one or more pressure-relief vents formed therein.

15. The accessory of claim 14 wherein the one or more vents have positionable closure means associated therewith.

* * * * *